US005727708A

United States Patent [19]

Erickson

[11] Patent Number: 5,727,708

[45] Date of Patent: Mar. 17, 1998

[54] FORM FIT THROW-AWAY LINER FOR A REUSABLE PAINT BUCKET INCLUDING ROLLER GRATE

[75] Inventor: Scott Walter Erickson, Bloomfield Hills, Mich.

[73] Assignee: Erickson Tool Design, Inc., Bloomfield Hills, Mich.

[21] Appl. No.: 747,586

[22] Filed: Nov. 13, 1996

[51] Int. Cl.[6] ..... B65D 25/16

[52] U.S. Cl. ..... 220/410; 220/570; 220/702; 206/514

[58] Field of Search ..... 220/570, 23.83, 220/23.86, 410, 408, 571.1, 699, 700, 701, 702, 697, 521, 527, 735, 736, 731, DIG. 12; 206/514

[56] References Cited

U.S. PATENT DOCUMENTS

| | | | |
|---|---|---|---|
| 1,111,159 | 9/1914 | Knox | 220/527 |
| 1,533,318 | 4/1925 | Ihling . | |
| 1,590,572 | 6/1926 | Fredette | 220/700 |
| 1,813,670 | 7/1931 | Kessler | 220/527 |
| 2,646,808 | 7/1953 | Yenne | 220/697 |
| 2,705,334 | 4/1955 | Farrow | 220/702 |
| 2,723,410 | 11/1955 | Sprung et al. . | |
| 2,763,880 | 9/1956 | Muleahy | 220/570 |
| 2,887,705 | 5/1959 | Serwer . | |
| 2,972,765 | 2/1961 | Macy et al. . | |
| 3,760,972 | 9/1973 | McKirnan . | |
| 3,850,298 | 11/1974 | Jolly . | |
| 3,905,476 | 9/1975 | Foreman . | |
| 4,122,973 | 10/1978 | Ahern . | |
| 4,145,789 | 3/1979 | Morgan, Sr. . | |
| 4,179,040 | 12/1979 | Bateman et al. . | |
| 4,555,339 | 11/1985 | Graves et al. . | |
| 4,651,379 | 3/1987 | Kern . | |
| 4,756,046 | 7/1988 | Surface et al. . | |
| 5,046,749 | 9/1991 | Owens . | |
| 5,085,317 | 2/1992 | Jensen et al. . | |
| 5,086,917 | 2/1992 | Dziersk et al. | 206/514 |
| 5,143,242 | 9/1992 | Millasich . | |
| 5,156,411 | 10/1992 | Owens . | |
| 5,207,344 | 5/1993 | Davies et al. | 220/408 |
| 5,207,348 | 5/1993 | Fischer et al. | 220/700 |
| 5,314,061 | 5/1994 | Bedrossian . | |
| 5,341,969 | 8/1994 | Accardo et al. . | |
| 5,400,916 | 3/1995 | Weber . | |
| 5,402,910 | 4/1995 | Pilney . | |
| 5,549,216 | 8/1996 | Scholl | 220/736 |

FOREIGN PATENT DOCUMENTS

| | | | |
|---|---|---|---|
| 2 179 275 | 3/1987 | United Kingdom | 220/570 |

*Primary Examiner*—Stephen J. Castellano
*Attorney, Agent, or Firm*—Harness, Dickey & Pierce, PLC

[57] ABSTRACT

A form-fit, disposable liner for a reusable plastic five gallon paint bucket. The liner is a thin, structurally rigid, single piece plastic liner formed by a suitable plastic molding process. The liner includes a cylindrically shaped side wall and a semi-circularly shaped bottom wall that conform to the side wall and bottom wall of the paint bucket. An integral roller landing extends down from a semi-circular shaped top wall at an angle thereto, into a vertically extending planar side wall. The roller landing includes a series of integrally molded ridges that allow a coating product stored in the liner to be loaded into a paint roller. A domed lid is provided that engages with a rim of the liner in a snap-fit engagement to allow the paint product in the liner to be sealed.

19 Claims, 2 Drawing Sheets

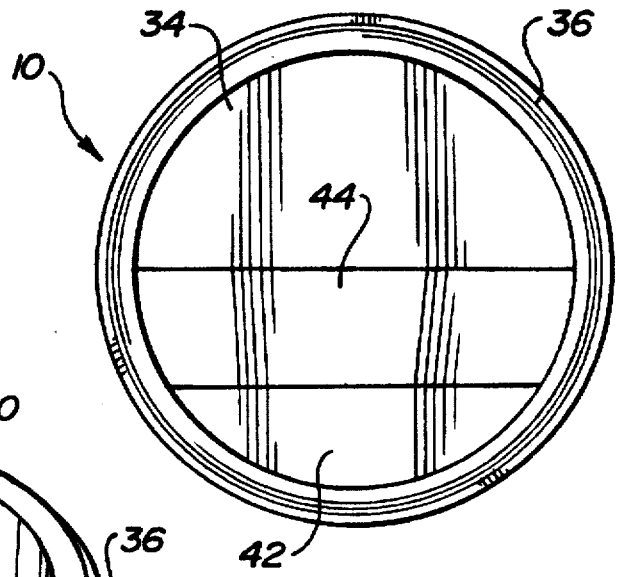
Fig-6
Fig-1
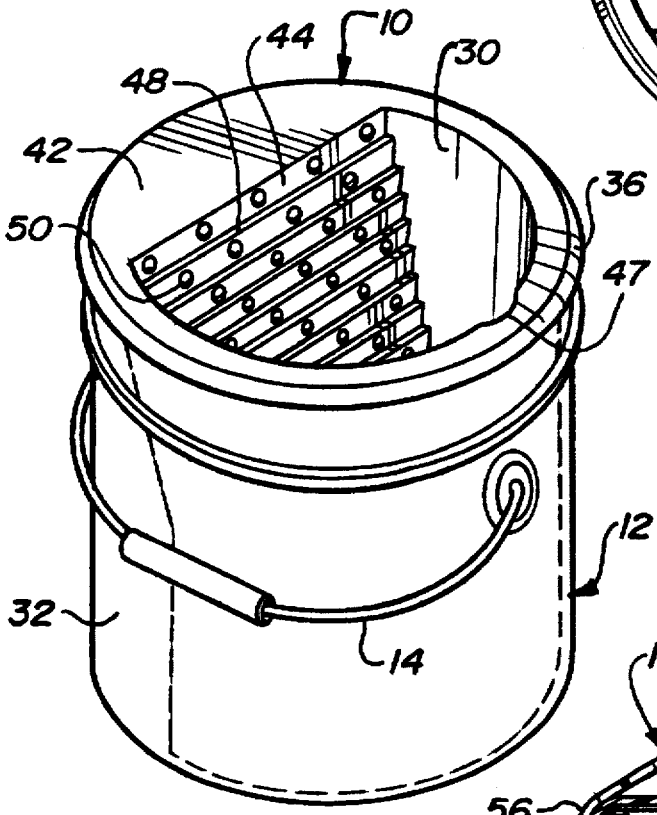
Fig-2
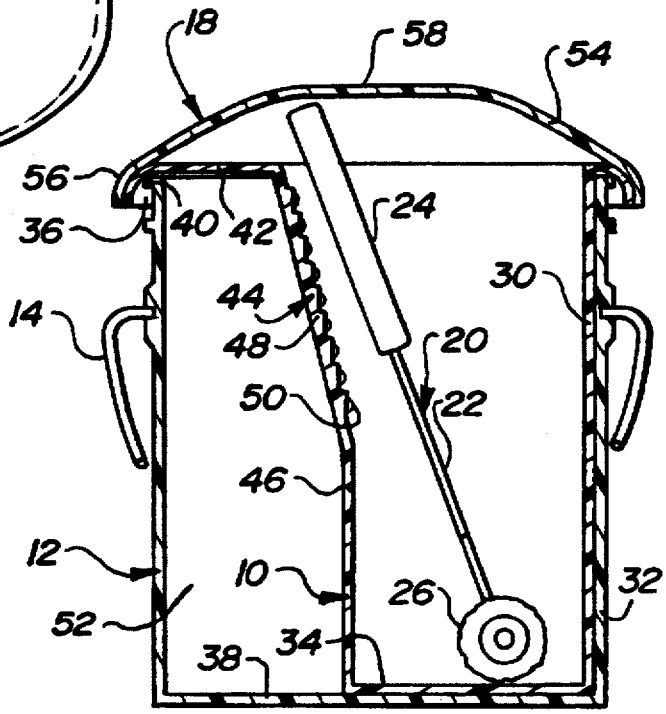

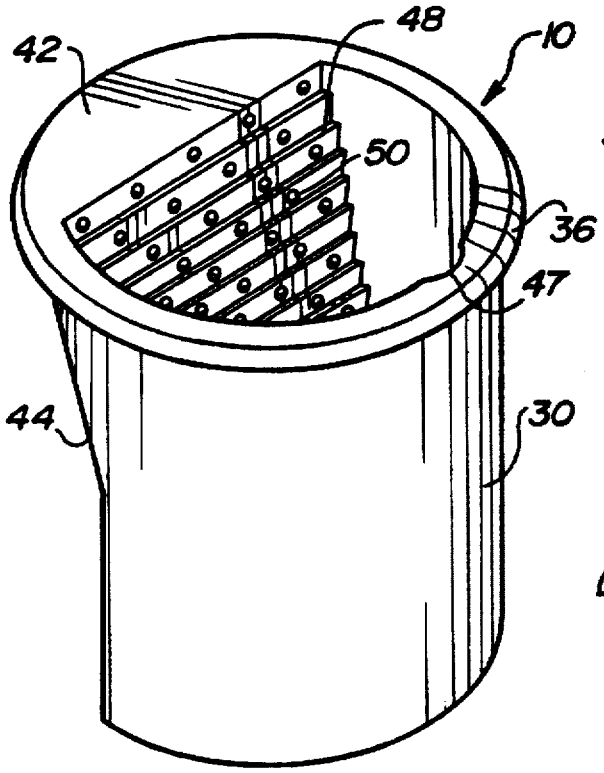
Fig-3
Fig-4
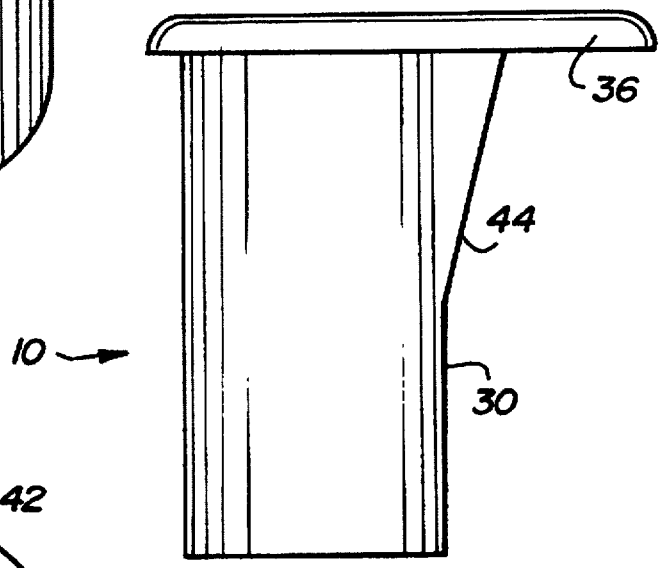
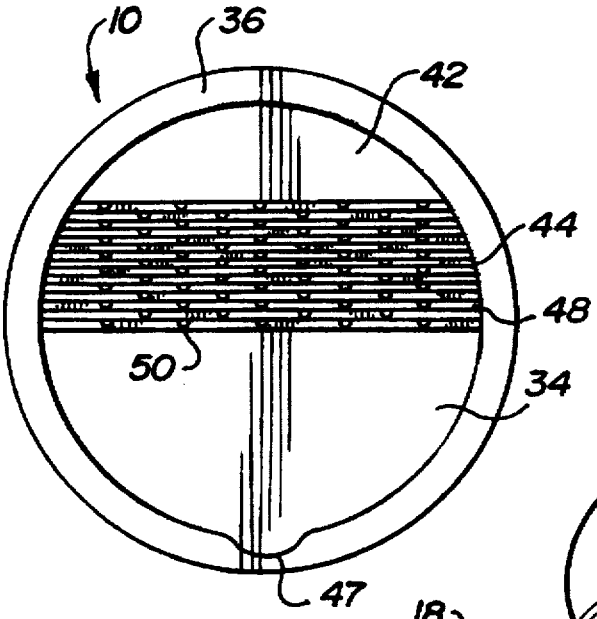
Fig-5
Fig-7
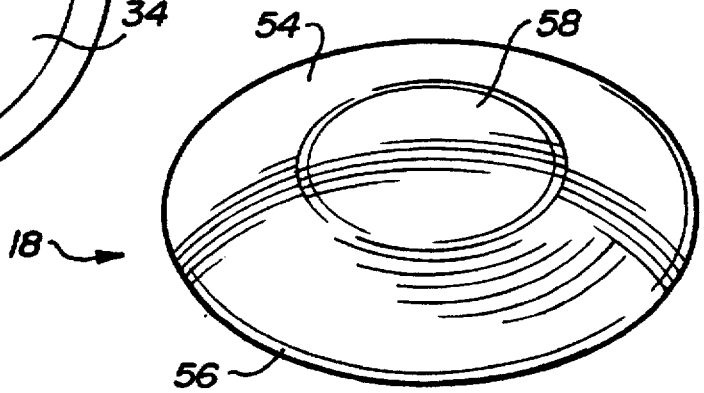

FORM FIT THROW-AWAY LINER FOR A REUSABLE PAINT BUCKET INCLUDING ROLLER GRATE

BACKGROUND OF THE INVENTION

1. Field of the Invention

This invention relates generally to a liner for a reusable bucket, and more particular, to a form fit, disposable plastic liner that is slidably engageable within a five gallon paint bucket, where the liner includes an integral roller grate and a snap-on lid.

2. Discussion of the Related Art

The market for painting products and accessories is a very large industry for both commercial and recreational painters. An important part of the painting accessories is some type of pail, bucket, or container for holding a coating product that is to be applied. Buckets that are used to hold the coating product, such as paint, shellac, lacquer, etc., to be dispensed by a brush, roller, sprayer, etc. onto a wall, ceiling, or other paintable structure, come in a variety of shapes and sizes. One particular type of bucket that is widely used to hold a coating product, especially for commercial painters, is a conventional five gallon plastic bucket having a metal handle.

A five gallon bucket provides a number of advantages for holding a coating product when applying the product to a paintable structure. These advantages include the ability to hold a large volume of the coating product, reduced risk of tipping or spilling the coating product during transportation, ability to suspend the bucket by a bucket hook from a ladder for above ground painting applications, wide availability of the buckets, etc.

Using a five gallon bucket to hold a quantity of a coating product during a painting job does, however, have disadvantages. For example, the time and labor required to clean the bucket after use is significant, and is costly for commercial painting. Solvents necessary to clean particular coating products, such as fast drying shellacs, also may be expensive. Further, it is difficult to clean the bucket well enough, so that subsequent use of the same bucket for different products over an extended period of time, may cause a new coating product to become contaminated with old product. Additionally, because the five gallon buckets do not come with a lid, skinning and lumping of the coating product within the bucket may present a problem if the product is stored in the bucket for a long enough period of time during a painting operation.

As mentioned above, one popular technique for dispensing a coating product, especially paint, onto a paintable structure is by a paint roller, well known to those skilled in the art. The paint roller allows a relatively large area to be painted quickly, at the same time providing an even coating of the paint. To accommodate use of a paint roller with the conventional five gallon bucket, it has heretofore been known to equip a five gallon bucket with a steel mesh grate, where the grate has hooks that engage a top lip of the bucket to secure it within the bucket. However, the steel mesh design of this type of roller grate makes extra work of properly loading a roller with the paint, thus adding time and cost to a painting job. This is because when the roller is dunked into the paint and rolled on the grate, the paint is forced through the grate instead of into the roller. Also, the grate may easily become caked with the coating product. And, the combination of the five gallon bucket with the mesh grate suffers the same problems as using the bucket alone.

Some of the problems presented by the steel grate design can be eliminated by using a conventional roller pan with the paint roller. The conventional roller pan is a flat pan having a roller grate for rolling the paint into the roller. The conventional roller pan is relatively easy to use, inexpensive to purchase, and widely available wherever paint products are sold. The conventional rolling pan does, however, have a number of disadvantages, including the pan does not hold very much paint, the paint is easily spilled from the pan, the pan is difficult to transport while holding the product, the pan cannot safely be used with ladders, and the pans do not come with a sealing lid to prevent contamination and skinning of the product.

Rolling vats are known that are larger than the conventional rolling pan, and offer an increase in time savings and stability of the vat during use. However, these vat type rolling pans are generally high priced, very labor intensive to clean, cannot be transported while full of the coating product, cannot be utilized while painting on a ladder, and do not include a mechanism to prevent skinning and contamination of the coating product.

What is needed is a paint bucket liner having an integral roller grate for increasing the cost effectiveness and efficiency of the painting process. Although paint bucket liners for inserting into paint buckets, and paint buckets including roller grates are known in the art, there is still room for improvement in each of these areas for providing a throw-away plastic paint bucket liner, including integral rolling grate, to further increase the cost effectiveness of painting.

SUMMARY OF THE INVENTION

In accordance with the teachings of the present invention, a form fit, disposable liner for a reusable plastic bucket is disclosed. The liner has particular application with a conventional five gallon bucket. The liner is a thin, structurally rigid, single piece plastic container formed by a suitable plastic molding process. The liner includes a cylindrically shaped side wall and a semi-circularly shaped bottom wall that conform to the side wall and bottom wall of the bucket. An integral roller landing extends down from a semi-circularly shaped top wall of the liner at an angle thereto, into a vertically extending planer side wall. The roller landing includes a series of molded "stair step" ridges that allow a coating product contained in the liner to be effectively rolled into a paint roller. A domed lid is provided that attaches to a rim of the liner in a snap-fit engagement to allow the coating product in the liner to be sealed if desirable. The dome shape of the lid also allows a conventional paint roller to be stored in the liner when the lid is on.

Additional objects, advantages and features of the present invention will become apparent from the following description and appended claims, taken in conjunction with the accompanying drawings.

BRIEF DESCRIPTION OF THE DRAWINGS

FIG. 1 is a perspective view of a paint bucket liner, according to an embodiment of the present invention, inserted within a five gallon paint bucket;

FIG. 2 is a cross-sectional view of the paint bucket liner of FIG. 1 within the paint bucket, including a snap-on lid and a paint roller positioned within the liner;

FIG. 3 is a perspective view of the paint bucket liner of the invention separated from the paint bucket;

FIG. 4 is a side view of the paint bucket liner of the invention;

FIG. 5 is a top view of the paint bucket liner of the invention;

FIG. 6 is a bottom view of the paint bucket liner of the invention; and

FIG. 7 is a perspective view of the lid of the paint bucket liner according to the invention.

DETAILED DESCRIPTION OF THE PREFERRED EMBODIMENTS

The following description of the preferred embodiments directed to a form fit, disposable liner for a reusable paint bucket, that includes an integral roller grate, is merely exemplary in nature, and is in no way intended to limit the invention or its applications or uses.

FIG. 1 is a perspective view showing a disposable liner 10, according to an embodiment of the present invention, positioned within a five gallon bucket 12. The liner 10 is a thin, structurally rigid, single piece plastic liner that has been formed by a suitable thermoforming, vacuum forming, injection molding, blow molding, or any other plastic molding process applicable to make the liner 10, as would be known to those skilled in the art. In one embodiment, the liner 10 is made of a polypropylene plastic, but as will be appreciated by those skilled in the art, any suitable plastic, such as polyethylene, PVC, etc., or any other specialty plastic or material resistant to a particular chemical or coating product can be used to make the liner 10.

The liner 10 is easily slidably engageable within the bucket 12 so that it can be readily removed and another liner inserted into the bucket 12 when desired. The bucket 12 is a conventional, standard size molded plastic bucket, known in the art, that is fourteen inches tall and eleven inches across the opening. A metal handle 14 is provided for carrying the bucket 12. The bucket 12 is universal and has use in a wide variety of applications, for example, containing paint products, plaster and drywall products, waxes, coolants, janitorial products, cleating agents, food, etc. The liner 10 in association with the bucket 12 will be described below as being a container for holding a paint product. However, as will be appreciated by those skilled in the art, the liner 10 can hold any suitable coating product that is to be dispensed by some type of brush, roller, sprayer, etc. Also, the liner 10 can be proportionally reduced or increased in size to be inserted into other sized buckets.

FIG. 2 shows a cross-sectional view of the liner 10 within the bucket 12. Additionally, a domed lid 18 is secured to the liner 10 in a snap-fit engagement, and a standard size paint roller 20, including a roller frame 22, roller handle 24 and roller head 26, is positioned within the liner 10. The lid 18 is a plastic lid molded separately from the liner 10. FIGS. 3–6 show separate views of the liner 10 removed from the bucket 12, without the lid 18, and FIG. 7 shows a perspective view of the lid 18 separated from the liner 10.

The liner 10 is a container that includes a cylindrical-shaped side wall 30 that conforms to a cylindrical side wall 32 of the bucket 12. The side wall 30 extends between a semi-circular shaped bottom wall 34 and a circumferential rim 36. The bottom wall 34 conforms with a circular bottom wall 38 of the bucket 12. The rim 36 extends away from the side wall 30 and curves downward, as shown, and is positioned around a top edge 40 of the bucket 12. The rim 36 allows a painter to easily grasp the liner 10 for putting it into, or removing it from the bucket 12. A semi-circular shaped top wall 42 extends from the rim 36 to an angled roller landing 44. The angled roller landing 44 extends down into the liner 10 at an angle from the top wall 42, and extends into a vertical planar side wall 46 as shown. The roller landing 44 flares outward as it travels downward from the top wall 42 towards the middle of the bucket 12. The roller landing 44 is about eleven inches wide at its widest point. The dimensions and relative positions of the top wall 42, the roller landing 44, the side wall 46, etc. can be any suitable dimension for ease of manufacture and use of the liner 10, as would be understood to those skilled in the art, for the purposes of the present invention. An indentation 47 is formed on the rim 36 to allow for ease of pouring if desired.

The roller landing 44 includes a series of integrally molded ridges 48 that extend down the length of the roller landing 44 in a "stair-step" manner, and extend across the entire width of the roller landing 44. In one embodiment, the ridges 48 are about ¼ inch apart from each other. The cleating action of the ridges 48 on the roller landing 44 prevents slipping of the roller head 26. The ridges 48 also hold paint so that the paint can be forced into the roller head 26 when loading. Additionally, the ridges 48 give the landing 44 added strength. The configuration of the ridges 48 allow a plurality of the liners 10 to be nested with each other for storage, without interlocking. A series of indentations 50 are also provided on the roller landing 44. The ridges 48 and indentations 50 are described by way of a non-limiting example, in that any other type of ridge, nub, indentation, etc., can be integrally molded into the landing 44 to provide a suitable mechanism for loading the roller head 26.

This configuration of the roller landing 44 provides a wide enough area to roll the standard width paint roller 20 along the landing 44 easily so that the paint is sufficiently loaded into the roller 20 for efficient painting. In one embodiment, the connection area between the landing 44 and the side wall 30 is curved or cup-shaped. This drains paint towards the middle area of the landing 44 to help load the ends of the roller head 26. Because the roller landing 44 is positioned towards the middle of the bucket 12 to accommodate the width of the roller head 26, a dead space 52 in the bucket 12 is lost to hold the coating product. In order to reduce the amount of the dead space 52, the wall 46 extends vertically downward from the roller landing 44, as shown.

The lid 18 includes a domed portion 54, a rim portion 56 and a flat top portion 58. The rim portion 56 is configured to interlock with an outside edge of the rim 36 to lock the lid 18 on the liner 10 to prevent air from entering the container 10. The domed portion 54 extends up from the rim portion 56 to accommodate the handle 24 of the roller 20 that extends out of the liner 10.

The disposable liner 10 and accompanying lid 18 provide an effective tool for the painter that allows the paint or other coating product to be stored in the liner 10 during a painting job, and is thereafter disposable so that the bucket 12 does not have to be cleaned. Further, a subsequent coating product can be poured into another liner without the concern of contaminating the current coating product with a previous coating product that was in the bucket 12. The liner 10 reduces cleanup and mess, and makes the entire painting job more desirable.

The foregoing discussion discloses and describes merely exemplary embodiments of the present invention. One skilled in the art will readily recognize from such discussion, and from the accompanying drawings and claims, that various changes, modifications and variations to be made therein without departing from the spirit and scope of the invention as defined in the following claims.

What is claimed is:

1. A liner for lining a bucket, said liner comprising:

a container portion configured to be inserted into the bucket, said container portion including a cylindrically configured side wall, an angled roller landing, a planer side wall, and an end wall all defining an enclosure, said angled roller landing extending down into the enclosure from a top wall to the planer side wall, said roller landing including a plurality of integral ridges; and a curved rim portion extending around the container portion and including a rounded edge portion configured to engage an edge of the bucket, said liner being a single piece plastic liner.

2. The liner according to claim 1 further comprising a domed lid, said domed lid including an edge portion that engages with the curved rim portion of the liner to secure the lid to the liner.

3. The liner according to claim 1 where the ridges are shaped in a stair-step configuration.

4. The liner according to claim 1 wherein the liner is shaped to be inserted in a five gallon cylindrical bucket.

5. The liner according to claim 1 wherein the angled roller landing is about eleven inches wide at its widest location.

6. The liner according to claim 1 wherein the angled roller landing flares outward into the container portion from the top wall of the container portion.

7. The liner according to claim 1 wherein the container portion is configured such that a space is provided between a cylindrical side wall of the bucket and the roller landing and planer side wall of the liner.

8. The liner according to claim 1 wherein the top wall is a semi-circular shaped top wall.

9. The liner according to claim 1 wherein the roller landing includes a plurality of indentations.

10. The liner according to claim 1 wherein the end wall is a semi-circularly shaped end wall.

11. A plastic liner for lining a five gallon cylindrical bucket, said liner comprising:

a semi-circularly configured top wall;

a cylindrically configured side wall;

a semi-circularly configured end wall integral with the cylindrically configured side wall;

a planer side wall integral with the cylindrically configured side wall and the end wall;

an angled roller landing integral with the top wall, the planer side wall and the cylindrically configured side wall, said roller landing being positioned at an angle to the top wall and the planer side wall, said roller landing including a plurality of integral ridges; and a curved rim portion being integral with the top wall and the cylindrically configured side wall, said curved rim portion being configured to engage an edge of the bucket.

12. The liner according to claim 11 further comprising a domed lid, said domed lid including an end portion that engages with the curved rim portion of the liner to secure the lid to the liner.

13. The liner according to claim 11 wherein the ridges are shaped in a stair-step configuration.

14. The liner according to claim 11 wherein the angled roller landing flares outward from the top wall to the planer side wall.

15. The liner according to claim 11 wherein the liner is configured such that a space is provided between a cylindrical side wall of the bucket and the roller landing and planer side wall of the liner.

16. The liner according to claim 11 wherein the roller landing includes a plurality of indentations.

17. A plastic liner for lining a five gallon cylindrical bucket, said liner comprising:

a semi-circularly configured top wall;

a cylindrically configured side wall;

a semi-circularly configured end wall integral with the cylindrically configured side wall;

a planer side wall integral with the cylindrically configured side wall and the end wall;

an angled planer roller landing integral with the top wall, the planer side wall and the cylindrically configured side wall, said roller landing extending at an angle from the top wall towards a middle area of the liner and connecting to the planer side wall at an angle thereto, said roller landing including a plurality of integral ridges;

a curved rim portion being integral with the top wall and the cylindrically configured side wall and being opposite to the end wall, said curved rim portion being configured to engage an upper edge of a bucket; and a domed lid, said domed lid including an end portion that engages with the curved rim portion of the liner to secure the lid to the liner.

18. The liner according to claim 17 wherein the roller landing flares outward from the top wall to the planer side wall.

19. The liner according to claim 18 wherein the roller landing is about eleven inches wide at its widest location.

* * * * *

UNITED STATES PATENT AND TRADEMARK OFFICE

CERTIFICATE OF CORRECTION

PATENT NO. : 5,727,708

DATED : March 17, 1998

INVENTOR(S) : Scott Walter Erickson

It is certified that error appears in the above-identified patent and that said Letters Patent is hereby corrected as shown below:

On title page, item [56],
under "References Cited", add:

| | | |
|---|---|---|
| --5,460,289 | 10/1995 | Gemmell |
| 5,489,051 | 2/1996 | Robinson-- |

Signed and Sealed this

Sixth Day of October, 1998

*Attest:*

*Attesting Officer*

BRUCE LEHMAN

*Commissioner of Patents and Trademarks*